United States Patent [19]

Necowitz

[11] Patent Number: 4,525,883

[45] Date of Patent: Jul. 2, 1985

[54] CONVERTIBLE BED

[76] Inventor: Loretta A. Necowitz, 823 Kingston Dr., Cherry Hill, N.J. 08034

[21] Appl. No.: 605,412

[22] Filed: Apr. 30, 1984

[51] Int. Cl.[3] ..... A47D 7/00

[52] U.S. Cl. ..... 5/93 B; 5/2 R; 5/100; 5/193; 5/425

[58] Field of Search ..... 5/2 R, 93 R, 52, 53 R, 5/93 B, 100, 193, 425

[56] References Cited

U.S. PATENT DOCUMENTS

| | | | |
|---|---|---|---|
| 1,378,518 | 5/1921 | Boardman | 5/100 |
| 2,059,240 | 11/1936 | Johnston | 5/100 |
| 2,287,452 | 6/1942 | Rossom | 5/2 R |
| 2,564,386 | 8/1951 | Webb | 5/93 R |
| 2,689,960 | 9/1954 | Lap | 5/93 R |
| 3,093,838 | 6/1963 | Beasley | 5/100 |
| 3,403,412 | 10/1968 | Gotfried et al. | 5/100 |

FOREIGN PATENT DOCUMENTS

| | | | |
|---|---|---|---|
| 799315 | 8/1958 | United Kingdom | 5/52 |

*Primary Examiner*—Gary L. Smith
*Assistant Examiner*—Michael F. Trettel
*Attorney, Agent, or Firm*—Thomas A. Lennox

[57] ABSTRACT

A full size bed is provided convertible to a crib to allow the child full range of movement including a frame with vertical cavities in each member of the frame into which vertical bars are inserted to fix guard rails around the periphery of the bed with a section of the guard rail a separable gate which connects using extensions of vertical bars to the adjacent edges of the guard rail.

16 Claims, 4 Drawing Figures

CONVERTIBLE BED

BACKGROUND OF THE INVENTION

This invention relates to a convertible bed, that is being convertible from a regular full size bed to a crib and back again, or to a day bed-sofa.

There have been a number of cribs which have been instructed to be convertible into a child's bed, generally by removing a section at the end of the crib or extending the length of the crib to realize the length of the growing child. These structures are described in the following U.S. Pat. Nos. 367,222 to L. C. H. Miller; 1,926,220 to F. W. Xiques, 494,560 to C. M. Floyd, 3,354,475 to C. T. Martin, 2,557,538 to E. L. Greenfelder, 2,496,068 to V. W. Rutkowski, 329,663 to J. C. McMurray, 101,489 to F. Menzer, 2,477,231 to E. R. Bourdon, 2,059,2420 to H. V. Johnston, 3,821,822 to J. L. Borreggine, and 4,361,919 to James R. Hull.

The purchase of a convertible "youth bed" which may start as a crib and later be opened up to a youth bed size still requires the purchase of two beds when the child grows out of the youth bed size into a full size bed. Many parents keep the child in the crib a longer than a desirable time and then move the child directly to a full size bed without any protection. The move of the child to the unprotected bed requires using all sorts of "stop-gap" measures to protect the child from rolling and falling out of bed during sleep. With the prior art beds, at least two separate bed purchases were always required and the difficulty of transition from a too small crib to a bed without sides was a traumatic experience for both the child and the parents.

These needs were not satisfied by the beds described in the patents above but these needs and the objects stated herein below are satisfied by the present invention.

SUMMARY OF THE INVENTION

None of the prior art has recognized the desirability of providing a crib space sleeping area as large as a full size adult bed. It is believed that a new born infant, in particular, is better off if allowed to crawl during sleep and not be restricted to crib size. It is believed that the young child is better off physically and mentally if he or she is not restricted to such a small space during the time before and after sleep and particularly during sleeping time. It is believed that the young child develops mentally and physically more quickly as a result of the larger space allowing free and more vigorous movement.

It is an object of this invention to provide a full size bed that is convertible to a crib and back to a full size bed.

It is an additional object of this invention to provide a full size sleeping area for the infant, but yet provide protection from the child rolling off the bed or getting out of the bed at times when the child should be going to sleep, at an age before he understands the restrictions placed upon him by his parents.

It is a further object of this invention to provide a bed which during the transition period from crib structure to the unobstructed bed structure, some of the railings may be left up to provide protection from inadvertent rolling off of the bed during the night, but yet allow the child to get up if the child wishes.

It is an additional object of this invention to provide a convertible bed that once it has been used as a crib and then opened up to form an unobstructed standard size bed, the railings may be used for a new full size frame purchased for a new baby in the family.

It is an additional object of this invention to provide a convertible bed which will be suitable as a crib, youth bed and full size bed, for a fully capable adult or an infirm or ill adult.

It is an additional object of this invention to provide a gate in the railings removable to allow the child to be removed or to leave the crib.

It is a further object of this invention to provide a bed where some of the railings may be removed to form a day bed or couch for use during the day.

This invention is a bed to hold a full size mattress capable of conversion to a child's crib including a frame to hold the mattress at a height such that the upper edge of the mattress is proximate to the top edge of the frame. The frame includes two side members, a head member and a foot member. A vertical passageway holding device is structurally attached to the inside of each frame member to provide a plurality of open vertical passageways capable of receiving and firmly holding vertical bar members in an upright position. Preferably, each frame member includes an outer face panel facing outwardly and structurally attached to an inner support panel with a space between the face and the support panels. Preferably, the frame members have a substantial vertical width and extend from the height of the upper edge of the mattress to a height proximate to the floor. A guard rail device to prevent a young child from falling off the bed or climbing out of the bed includes sections with each section to rest proximate to the top edge of the frame members. Each section of the guard rail includes an upper horizontal rail, a plurality of vertical bar members and a lower horizontal rail, all structurally attached to each other to form a separate unit in the general shape of a horizontal ladder. A plurality of the vertical bar members, preferably three to five along the length of the bed and preferably two to four along the head or the foot of the bed extend vertically downwardly past the lower horizontal support rail into the vertical passageway holding device, which is preferably positioned in the space between the face and support panels of the frame. The holding device is preferably located at the space between the face and the support panels to receive the extended vertical bar members and firmly hold the bar members and thus the guard rail in an upright position. At least at one of the guard rail sections includes a separable gate length of the guard rail detachably connected at abutting edges to adjacent upper horizontal rails of adjacent sections and having at least two extended vertical bar members extending downwardly to be held in the vertical passageway holding device.

BRIEF DESCRIPTIONS OF DRAWINGS

Figure 1:
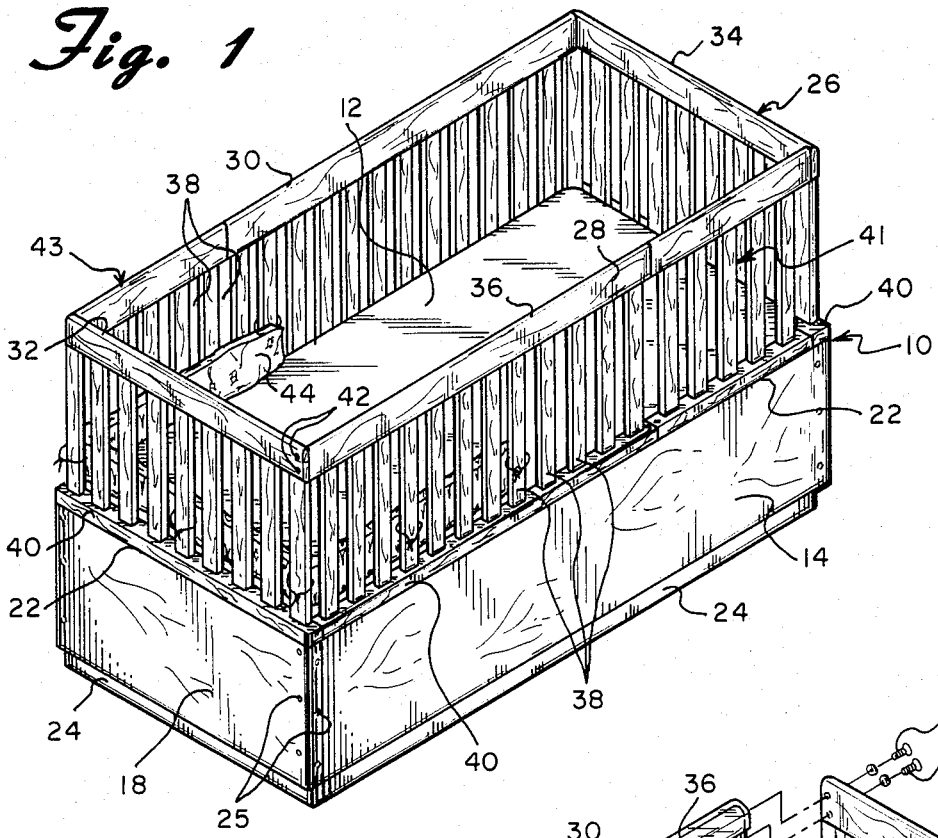
FIG. 1 is a perspective view of a bed of the present invention in the crib mode.
Figure 4:
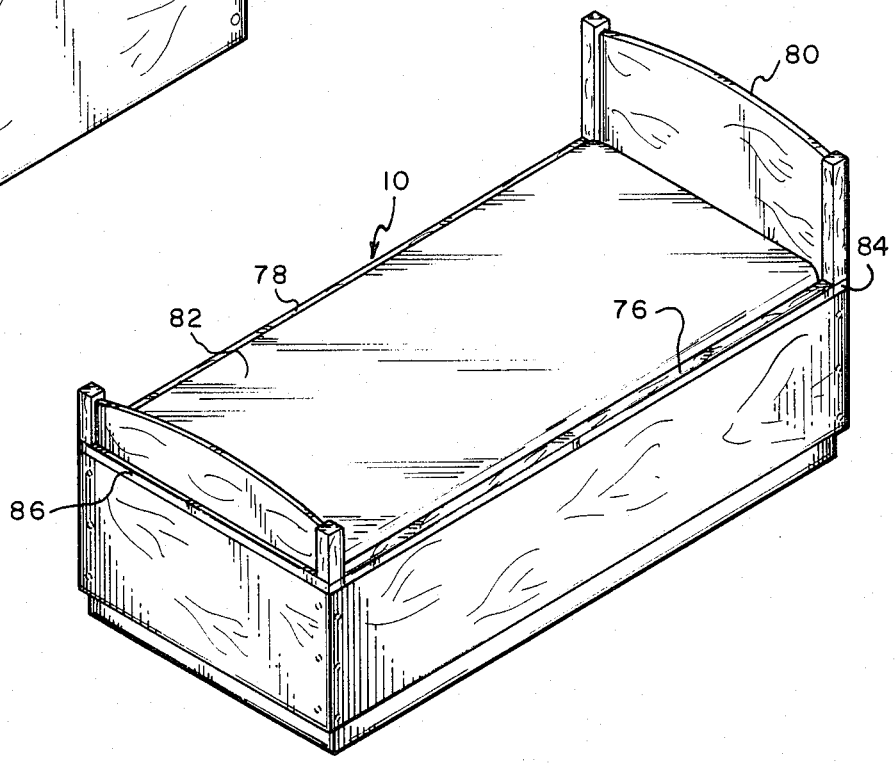

The perspective view of FIG. 4 illustrates the bed of FIG. 1 wherein all the rails have been removed leaving a full size adult bed, and foot and head boards have been added.

DESCRIPTION OF PREFERRED EMBODIMENTS

In FIG. 1, convertible bed 10 is illustrated with all of the rails in place in the crib mode. Mattress 12 is held in the frame of bed 10 which includes side member 14, side member 16 (hidden in this view), head member 18 and foot member 20 (hidden in this view). All of the frame members extend downwardly from top edge 22 close to the floor near kick rail 24. The frame members are connected at the corners using wood screws 25. Guard rail system 26 includes side sections 28 and 30, head section 32, and foot section 34. Each section includes upper rail 36, vertical bars 38 and lower horizontal rail 40. Each section of the guard rail is a separate structural part connected together with wood glue and other fasteners and each section is connected to the adjacent section by wood screws. For example upper horizontal rail 36 of side section 28 is connected to the adjacent upper horizontal rail of head section 32 by screws 42. Crib head bumpers 44 may be provided around the entire periphery of the interior of the bed to protect the baby in the early months from resting against a hard surface. Gate length 41 of section 28 is further described in FIG. 3. Gate length 43 is identical to gate length 41.

Figure 2:
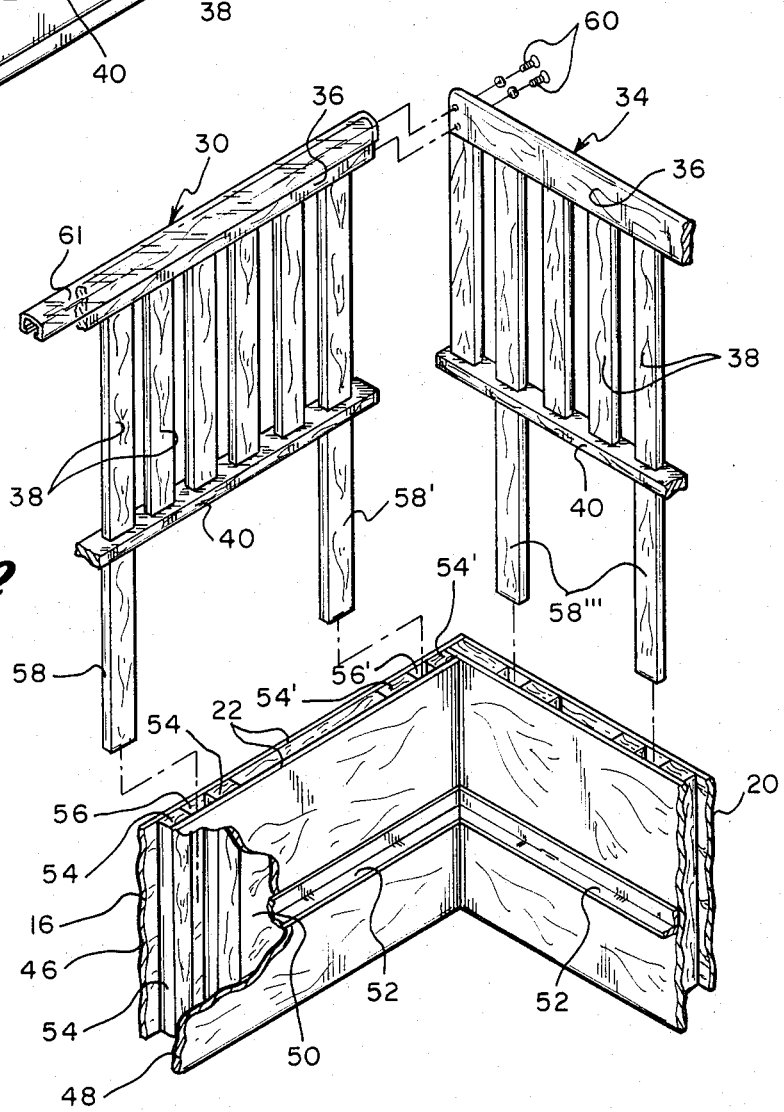
FIG. 2 is a partially exploded expanded perspective view partially cut away to illustrate the construction of the bed in FIG. 1.

In FIG. 2, the internal structure of bed 10 is illustrated wherein side member 16 is cut away to show outer face panel 46 and inner support panel 48 each structurally attached with glue and fasteners to form space 50 as a hollow core. "L" shaped metal bracket extrusion 52 is structurally attached to the interior surface of inner support panel 48 on which the box spring and mattress 12 rest. Vertical block members 54 are structurally attached between panels 46 and 48 to form vertical passageway 56 into which extension 58 of bar 38 is inserted. Similarly, extension 58' extends into passageway 56' formed vertical by block members 54'. Block members 54 are slightly closer to each other at the bottom than at the top to more firmly hold extensions 58. Foot rail section 34 interconnects with foot member 20 through extensions 58''' of bars 38. The upper rails 36 of side section 30 and foot section 34 are connected with bolts 60. Transparent plastic "C" shaped extruded teething rail 61 is snapped into horizontal channels cut into the upper sides of rails 36.

Figure 3:
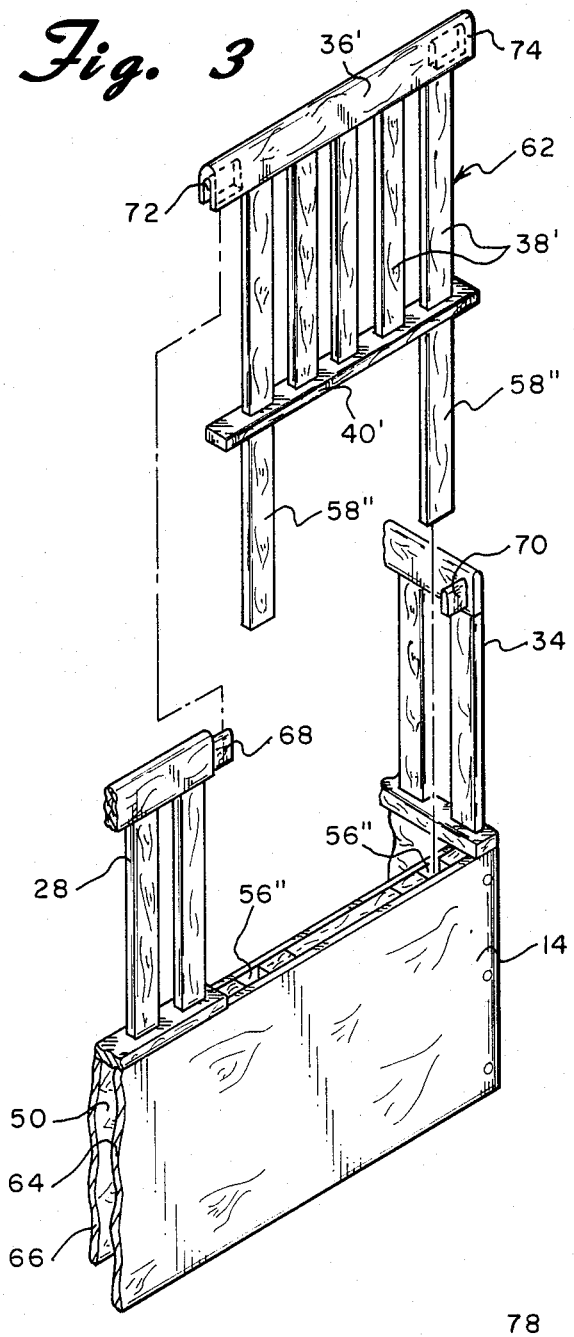
FIG. 3 is a partially cut away perspective view of a section of the bed in FIG. 1 illustrating a gate as it is removed from the bed.

In FIG. 3, gate section 62 is one piece unit of upper horizontal rail 36', vertical bars 38' and lower horizontal rail 40'. Vertical bar extensions 58'' are constructed to interfit into vertical passages 56'' in side member 14, which is constructed of outside surface panel 64 and inner support panel 66. Quarter inch wide lug extension 68 extends horizontally into the opening for gate section 62 from the upper horizontal rail of side section 28 and lug extension 70 extends horizontally from the upper horizontal rail of foot section 34. Channel 72 and channel 74 (hidden) are hollowed out of upper rail 76 at each end opening to the side and the bottom of the rail such that when gate section 62 is lowered and extension 58'' are inserted into passages 56'', channels 72 and 74 fit over and engage lug extensions 68 and 70 respectively, to hold gate section 62 firmly in place. Additional metal fasteners may be added at the abutting edges of the gate length and the adjacent rail section for further support to prevent excessive horizontal movement of the joint.

In FIG. 4, the entire rail system 26 has been removed to convert bed 10 into a full size adult bed. Side cover rails 76 and 78 have been added connected to short vertical members which fit into passages 56 to secure the rails in position. Head board 80 and foot board 82 have been added connected to cover rails 84 and 86 which interfit into passages 56 in the same fashion as cover rails 76 and 78.

As illustrated in FIG. 1, gate lengths 41 and 43 are on opposite sides of the bed and at opposite diagonal corners. The positioning of the gates and the size of the gates may vary widely. Preferred embodiments include the gate system of FIG. 1, two gates on the same side of the bed of equal size and one whole side being a single gate. For best structural support, it is preferred that the guard rail sections be connected at the corners through screws when a gate length is not involved. If one entire side of the rail system is a gate or is a plurality of gates, removal of the entire side allows easy transition to change the bed or create a couch for daytime use. Back support pillows may be added resting against the remaining rail sections.

It is preferred that at least one of the guard rails sections comprise at least two separable lengths, at least the first length being structurally attached at one end to the abutting end of another adjacent section of the guard rail system to form a corner. The other length of the guard rail section abuts the first length on one end and abuts a second adjacent section of the guard rail system at a second corner. This other and second length is held in position by engagement of at least two extending bar members into the frame and by detachable fastening means to connect the abutting ends of the adjacent upper horizontal rails. It is further preferred that the gate length of the guard rail is detachably connected by having a horizontal lug extend from each abutting edge of adjacent upper horizontal rails into the space where the gate length fits and having a channel of a size to receive the lug on each end of the upper horizontal rail of the gate length, that channel opening to the bottom surface of the upper rail and to end of the upper rail to allow the gate length to be engaged to the bed frame from above and allow the channels to interfit over the lugs. It is further preferred that the holding device to hold the bar extensions include a pair of vertical block members structurally attached between the face panel and the support panel of the frame aligned to form a vertical passage between them to provide sliding pressure fit for the extended vertical bar members. It is an additional preferred embodiment that the pair of vertical block members extend vertically from the top of the frame to the base of the frame and further that the blocks be angled such that the vertical passage way between the blocks closes slightly vertically downwardly to form a press fit of the extended vertical bar members.

While this invention has been described with reference to the specific embodiments disclosed herein, it is not confined to the details set forth and the patent is intended to include modifications and changes which may come within and extend from the following claims.

It is claimed:

1. A bed to hold a full size mattress capable of conversion to and from a child's crib comprising:

(a) a frame to hold the full size mattress at a height such that the upper edge of the mattress is proximate to the upper edge of the frame, comprising two side members, a head member and a foot member, (b) a holding means structurally attached to the inside of each frame member to provide a plurality of vertical passageways capable of receiving and holding vertical bars in an upright position, and (c) a guard rail means to prevent a young child from falling off the bed or climbing out of the bed, comprising a plurality of sections, each section to rest proximate to the top edge of the frame members and each section comprising an upper horizontal rail, a lower horizontal rail, and a plurality of vertical bar members staggered horizontally, extending between the upper and lower rails, and structurally attached at their ends to the rails to form a horizontal ladder shape, wherein a plurality of the vertical bar members extend downwardly past the lower horizontal rail into the open passageways of the holding means, and wherein at least one of the guard rail sections comprises a separable gate length of the guard rail section detachably connected at abutting edges to adjacent upper horizontal rails and having at least two extended vertical bar members extending into the holding means.

2. The bed of claim 1 wherein at least one of the guard rail sections comprises at least two separable lengths, at least one first length being structurally attached at one end to the end of another adjacent section to form a corner of the guard rail and the other length abutting the first length on one end and abutting a second adjacent section at a second corner, this other length being held in position by engagement of at least two extended bar members into the frame and by detachable fastening means to connect the abutting ends of the adjacent upper horizontal rails.

3. The bed of claim 1 wherein the gate length of the guard rail is detachably connected by having (a) a horizontal lug extended from each abutting edge of adjacent upper horizontal rails into the space where the gate length fits, and (b) a channel of a size to receive the lug on each end of the upper horizontal rail of the gate length, the channel opening to the bottom surface of the upper rail and to the end of the upper rail, to allow the gate length to be engaged to the bed frame firm above and allow the channels to interfit over the lugs.

4. The bed of claim 1 wherein the channel holding means comprises a plurality of channels formed in a space sandwiched between an outer face panel facing outwardly structurally attached to an inner support panel to form each frame member and a holding means located in the space between the face and support members to receive the extended vertical bar members and firmly hold the bar members in an upright position.

5. The bed of claim 4 wherein the holding means comprises a pair of vertical block members structurally attached between to the face panel and the support panel, aligned to form a vertical passageway between them to allow a sliding close fit of the extended vertical bar members in the passageway.

6. The bed of claim 5 wherein the pair of vertical block members extend vertically from the top edge of the frame to the base of the frame.

7. The bed of claim 6 wherein the vertical block members are angled such that the vertical passageway closes slightly vertically downwardly to form a close fit of the extended vertical bar members in the passageway.

8. The bed of claim 4 wherein cover means are provided to detachably attach to the top edge of the frame and cover the holding means passageways between the face panel and the support panel.

9. The bed of claim 8 wherein the head and foot cover means extend from edge to edge of the frame.

10. The bed of claim 1 wherein the upper edge of the mattress is flush to the top edge of the frame.

11. The bed of claim 1 wherein there are two separable gate lengths, each connected to two separate side members and connected to diagonally opposite corners of the guard rail means.

12. The bed of claim 1 wherein the gate length of a guard rail section is one-half the length of a side member.

13. The bed of claim 1 wherein there are two gate lengths which together take an entire section of the guard rail proximate to the length of a side member, wherein both gate lengths are detachably connected at abutting edges to adjacent upper horizontal rails at the corners and detachably connected to each other at the abutting edges.

14. The bed of claim 1 wherein the bed further comprises cover means to detachably attach to the top edge of the frame to cover the vertical passageway holding means when the guard rail means have been removed.

15. The bed of claim 1 wherein the height of the frame is such that the space under the mattress and box spring is sufficient to store the guard rail means when not in use.

16. A bed to hold a full size mattress capable of conversion to a child's crib comprising:

(a) a frame to hold the mattress at a height such that the upper edge of the mattress is proximate to the top edge of the frame, comprising two side members, a head member, and a foot member, wherein each member comprises an outer face panel facing outwardly, structurally attached to an inner support panel with a space between the face and support panels.

(b) a guard rail means to prevent a young child from falling off the bed or climbing out of the bed, comprising a plurality of sections, each to rest on the top edge of the frame members and each section comprising an upper horizontal rail, a plurality of vertical bar members, and a lower horizontal rails, all structurally attached together to form a horizontal ladder shape, wherein a plurality of the vertical bar members extend downwardly past the lower horizontal support rail into the space between the face and support members of the frame, and (c) holding means located at the space between the face and suppport members to receive the vertical bar member extensions and firmly hold the bar members in an upright position wherein at least one of the guard rail sections comprises a separable gate length of the guard rail section detachably connected at abutting edges to adjacent upper horizontal rails and having at least two extended vertical bar members extending to be held vertically in the holding means.

* * * * *